United States Patent [19]

Rusich

[11] 4,090,461

[45] May 23, 1978

[54] SAIL BOAT MAST CONTAINING SAIL FURLING DEVICE WITH SWIVEL HAUL-UP MEANS

[76] Inventor: Anthony Rusich, 4 Washington Pl., Port Washington, N.Y. 11050

[21] Appl. No.: 800,209

[22] Filed: May 25, 1977

[51] Int. Cl.[2] ..... B63H 9/04

[52] U.S. Cl. ..... 114/107; 114/90

[58] Field of Search ..... 114/39, 102, 104–108, 114/112–115, 90

[56] References Cited

U.S. PATENT DOCUMENTS

| | | | |
|---|---|---|---|
| 2,476,403 | 7/1949 | Cook | 114/114 |
| 3,800,728 | 4/1974 | Dowling | 114/105 |
| 3,802,373 | 4/1974 | Lagerquist | 114/105 |
| 3,835,804 | 9/1974 | Jackson | 114/107 |
| 3,851,609 | 12/1974 | Stearn | 114/105 |

FOREIGN PATENT DOCUMENTS

| | | | |
|---|---|---|---|
| 2,239,496 | 2/1974 | Germany | 114/107 |
| 1,340,777 | 12/1973 | United Kingdom | 114/107 |

*Primary Examiner*—Trygve M. Blix
*Assistant Examiner*—Stuart M. Goldstein
*Attorney, Agent, or Firm*—Eyre, Mann, Lucas & Just

[57] ABSTRACT

A hollow mast having a longitudinal slot in the aft end thereof contains a stationary tension member supporting a rotatable rod having at least one C-shaped groove longitudinally disposed therein parallel to the tension member. The C-shaped groove is adapted to retain a bead located in the luff of a sail. A swivel surrounding the rod provides a rotatable part for hoisting the sail and a non-rotatable part for attachment of a sail hoisting halyard. A rotator is provided for rotating the rotatable member whereby the sail is furled about the rotatable member protected within the mast.

8 Claims, 6 Drawing Figures

FIG 1
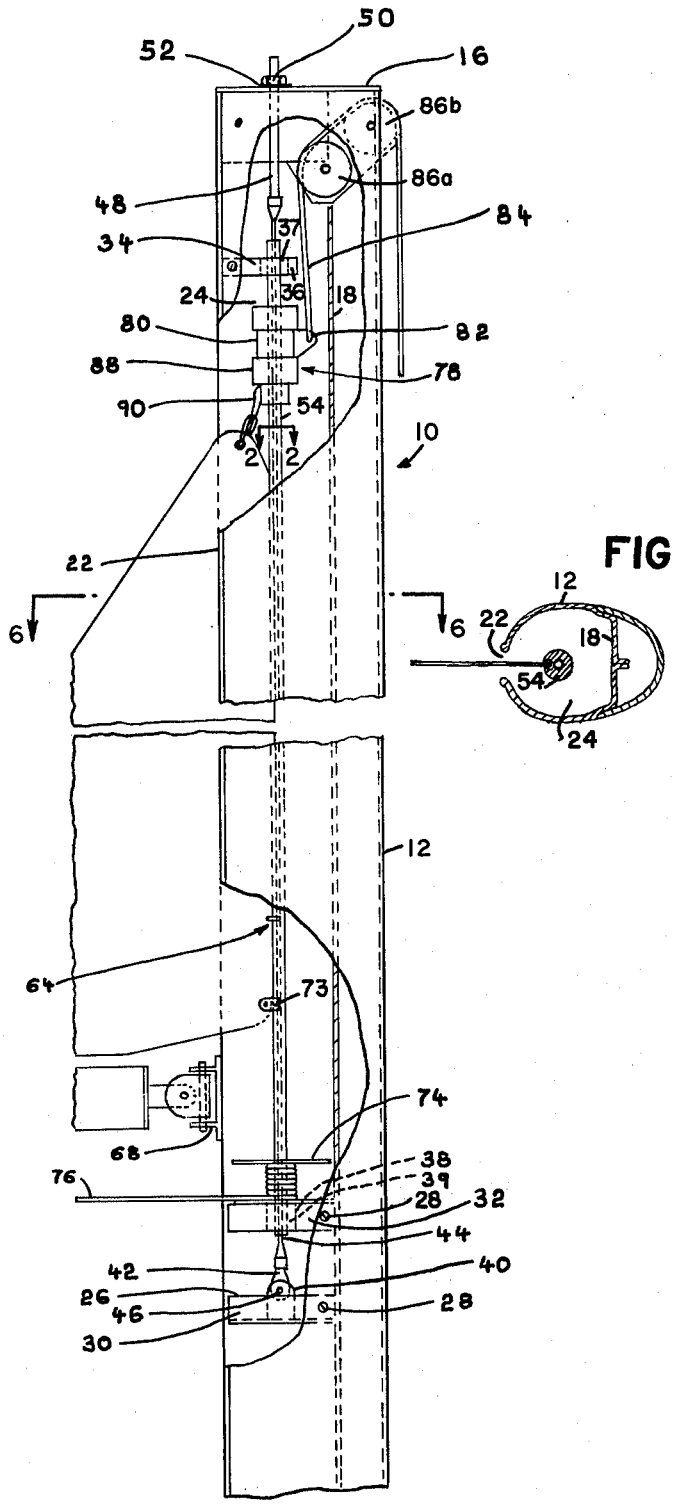
FIG 2
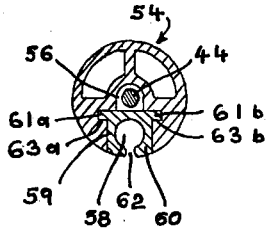
FIG 3
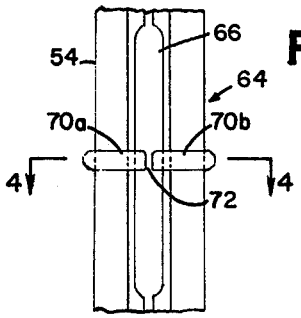
FIG 6
FIG 4
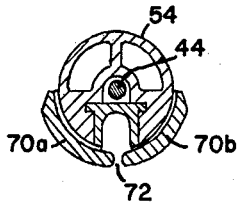
FIG 5
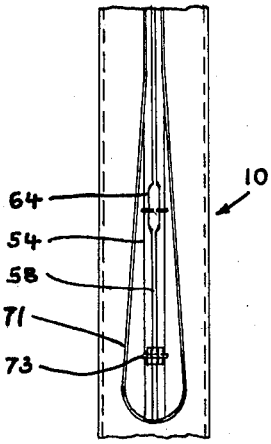

SAIL BOAT MAST CONTAINING SAIL FURLING DEVICE WITH SWIVEL HAUL-UP MEANS

BACKGROUND OF THE INVENTION

Sail furling devices are known in the art. For example, a roller reefer in U.S. Pat. No. 3,285,215 teaches the reefing of a sail about a boom by rotating the boom and allowing the sail to slide down a retaining means on the mast as its lower end becomes wrapped around the boom. Another method of furling a sail is taught in U.S. Pat. No. 3,332,384 in which the entire mast of a sail boat is rotated thus causing the sail to be wrapped up on the mast. A sail retaining means adapted to use with jib sails is taught in U.S. Pat. No. 3,948,200. This patent teaches a C-shaped groove which grasps the bead along one edge of a jib and allows rapid insertion and removal of a jib sail in the groove and further allows the jib sail to be furled about the rod containing the C-shaped groove. Another sail furling device is shown in U.S. Pat. No. 3,749,042. A sail furling arrangement is taught in U.S. Pat. No. 3,835,804 in which the luff of a sail is attached to a tension member within a hollow mast. When the tension member is rotated, the sail becomes reefed on the tension member within the mast. This arrangement makes no provision for easy removal and replacement of the sail once installed except by complete removal of the tension member.

BRIEF DESCRIPTION OF THE DRAWINGS

FIG. 1 shows a perspective view of the invention partly cut away to reveal internal details.

FIG. 2 shows a cross section taken along 2—2 of FIG. 1.

FIG. 3 shows a detailed elevation of the sail feeder.

FIG. 4 shows a cross section taken at 4—4 in FIG. 3.

FIG. 5 shows a detailed elevation of a part of the aft of the mast.

FIG. 6 shows a cross section of the mast taken along 6—6 in FIG. 1.

DETAILED DESCRIPTION OF THE PREFERRED EMBODIMENT

Referring to FIGS. 1 and 6, the sail boat mast, shown generally at 10 has an outer shell 12 and a top end plate 16. The outer shell 12 may optionally have lateral reinforcing members such as the septum 18. The bottom end of the mast (not shown) may be stepped in a sail boat by well known means. A longitudinal slot 22 located along the entire aft of the outer shell 12 yields access to the aft interior cavity 24. A lateral bulkhead 26 is located in the aft interior cavity 24 near the bottom of the mast and is retained in position by conventional means such as screws 28 passing through the outer shell 12 and into a flange 30 on the lateral bulkhead 26. A lower guide plate 32 is located above the lateral bulkhead 26 and is similarly secured by conventional means such as screws 28. An upper guide plate 34 is located in the aft interior cavity 24 just below the top end plate 16. The upper guide plate 34 has a guide hole 36 containing a bearing 37 therein. The lower guide plate 32 has a similar guide hole 38 and a bearing 39. A clevis member 40 is affixed to the lateral bulkhead 26. An eye bolt 42 is affixed to the bottom end of a tension means such as cable 44 by conventional means such as swaging. The eye bolt 42 is attached to the clevis member 40 by a clevis pin 46. The upper end of the cable 44 is attached to a threaded rod 48 which passes through a hole in the top end plate 16.

A nut 50 and washers 52 on the outer end of the threaded rod 48 enable tension to be applied to the cable 44. The cable 44 runs from the clevis 40 to the top plate 16 approximately concentrically through the upper guide plate 34 and the lower guide plate 32. A rod 54, better shown in FIG. 2, having a generally cylindrical outer shape and a concentric longitudinal opening 56 therein is threaded upon cable 44 with the cable 44 loosely occupying the concentric longitudinal opening 56. The rod 54 is free to rotate about the cable 44. The rod 54 is conveniently made of extruded aluminum for the lightness in weight and flexibility of shape this method provides. The rod 54 contains a C-shaped groove 58 longitudinally parallel to the concentric longitudinal opening 56. The C-shaped groove 58 is formed in a keying strip 59 and has a generally circular perimeter 60 and an opening 62 at the surface of the rod 54 which is narrower than the maximum diameter of the C-shaped groove 58. The keying strip 59 has a generally T-shaped cross section with lugs **61*a*, 61*b* projecting therefrom and engaging matching grooves 63*a*, 63*b* in the rod 54. The keying strip 59 forms part of the perimeter of the concentric longitudinal opening 56. The keying strip 59 allows the rod 54 to be made up of two or more pieces with the keying strip 59** bridging the individual pieces.

Referring again to FIG. 1, a sail feeder is located generally at 64. The sail feeder is shown in detail in FIGS. 3 and 4. In FIG. 3, the C-shaped groove is widened for a length 66 along the rod 54 near the point at which the sail boom attachment 68 is affixed to the mast 10. Feeder fingers **70*a*, 70*b* are attached to the rod 54 leaving a narrow gap 72 between their tips. A sail having a bead at its luff edge may be fed through the narrow gap 72 with the bead passing behind the feeder fingers 70*a*, 70*b* and the bead may thereafter be drawn upward engaging in the C-shaped groove 58. The sail may thus be hauled up by feeding the luff into the sail feeder 64** while the top of the sail is being hoisted toward the masthead.

Referring now to the detailed drawing in FIG. 5, access to the interior of the mast 10 for attaching feeding and removing the sail is provided by a hand access opening 71. A sail tack fitting 73 is located on rod 54 below the sail feeder 64. The sail tack fitting 73 holds down the foot of the sail. A removable pin, not shown, is used to attach and detach the sail tack to the sail tack fitting 73 for installing and removing the sail.

Returning now to FIG. 1, the rod 54 is guidably located within the bearing 37 in guide hole 36 in upper guide plate 34 and in the bearing 39 in guide hole 38 in lower guide plate 32. The guiding fit of the rod in the upper and lower bearings 37, 39 supports at least a portion of the lateral thrust due to wind pressure on the sail and also allows the rod 54 to be rotated. The mast 10 is provided with a means for rotating the rod 54 with respect to the mast 10. In the embodiment of FIG. 1, a sheave 74 is affixed to the guide rod above the lower guide plate 32. The sheave 74 is rotated for example by means of a cable 76 which is attached to a winch, not shown. When the sheave 74 is rotated by the cable 76, it in turn causes the rod 54 to rotate. A sail which is secured by the bead being engaged in the C-shaped groove 58 is thus wound upon the rod 54 and thereby accomplishes sail furling. The rod 54 could be rotated by other means such as gears or ratchets without departing from the spirit of the invention. A haul-up swivel shown generally at 78 is concentrically located about the rod 54. The haul-up swivel 78 comprises an upper member 80 having a hoist attachment 82 upon which the end of the halyard 84 is affixed. The halyard 84 passes over one or more pulleys 86*a*, 86*b*. The haul-up swivel 78 has a lower member 88 which is rotatable relative to the upper member 80 using, for example, ball bearings or the like. The lower member 88 has a sail haul-up loop 90 to which the top of the sail may be affixed. After the sail is installed and hauled up by the haul-up swivel 78, the rod 54 may be rotated to wind up the sail. This causes the lower member 88 to rotate with the top of the sail while the upper member 80 remains unrotated in order to avoid fouling the halyard.

If for any reason it is desired to remove the sail from the mast, the sail is unfurled from the rod 54 and the halyard is slackened to allow the luff of the sail to be slid downward between the fingers 70*a*, 70*b* of the said feeder 64 until the haul-up swivel is brought down to the sail feeder 64. The top of the sail can thereupon be disengaged from the sail haul-up loop 90 and the sail can be completely removed.

It will be understood that the claims are intended to cover all changes and modifications of the preferred embodiments of the invention, herein chosen for the purpose of illustration which do not constitute departures from the spirit and scope of the invention.

What is claimed is:

1. In a sailboat mast of the type having a cavity therein for holding a sail which has a bead in its luff, the improvement comprising:

(a) a tension means having first and second ends in said cavity parallel to the axis of said mast;
(b) means for supporting the first and second ends of said tension member and for applying tension thereto;
(c) a rod surrounding said tension means;
(d) said rod being rotatable on said tension means;
(e) a C-shaped groove in said rod for retaining said bead;
(f) a swivel having first and second parts slidably disposed on said rod;
(g) means for attaching a sail-hoisting halyard to said swivel first part;
(h) means for attaching the head of said sail to said swivel second part;
(i) means for attaching a sail tack to said rod;
(j) a longitudinal slot in the aft of said mast at least along the entire length of the luff of the sail;
(k) means for rotating said rod upon said tension means whereby said sail is furled upon said rod within said mast;
(l) the swivel second part rotating with the rod and the sail; and
(m) the swivel first part being held substantially non-rotating.

2. The sailboat mast recited in claim 1 further comprising a sail feeder which comprises:

(a) a longitudinal enlargement in a portion of said C-shaped groove whereby the C shape is changed to approximately a U shape;
(b) first and second feeder fingers attached to said rod; and
(c) the tips of said first and second fingers being opposed and spaced apart over the longitudinal centerline of said longitudinal enlargement.

3. The sailboat mast recited in claim 1 further comprising at least one bearing attached to said mast, said rod being disposed within said at least one bearing whereby said bearing supports said rod against lateral force.

4. The sailboat mast recited in claim 3 wherein said at least one bearing comprises a first bearing located above the top of the head of the fully hoisted sail and a second bearing below the tack of a sail.

5. The sailboat mast recited in claim 1 wherein said means for rotating comprises a sheave attached to said rod and a cable wound upon said sheave.

6. The sailboat mast recited in claim 2 further comprising a hand access opening in said mast adjacent to said sail feeder.

7. The sailboat mast recited in claim 1 wherein said rod has a cylindrical outside shape.

8. The sailboat mast recited in claim 1 wherein said tension means comprises a cable.

* * * * *